United States Patent [19]

Uyeda

[11] 4,197,726

[45] Apr. 15, 1980

[54] COMBINATION LOCKS

[75] Inventor: Tim M. Uyeda, South San Gabriel, Calif.

[73] Assignee: La Gard, Inc., Torrance, Calif.

[21] Appl. No.: 824,986

[22] Filed: Aug. 15, 1977

[51] Int. Cl.[2] ..... E05B 37/00; E05B 63/00

[52] U.S. Cl. ..... 70/332; 70/333 A; 350/114

[58] Field of Search ..... 70/320, 330, 331, 332, 70/333 A, 442, 443, 444, 445, 446; 350/112, 113, 115, 116, 97, 111, 175 LD, 114

[56] References Cited

U.S. PATENT DOCUMENTS

| | | | |
|---|---|---|---|
| 212,359 | 2/1879 | Corbett et al. | 70/333 A X |
| 1,435,992 | 11/1922 | Strauss et al. | 70/333 A X |
| 1,493,218 | 5/1924 | Morgan | 70/333 A |
| 1,855,947 | 4/1932 | Disbrow | 70/333 A X |
| 2,601,841 | 7/1952 | Zindel | 70/333 A |
| 2,690,664 | 10/1954 | Miller | 70/332 X |
| 2,728,215 | 12/1955 | Bremer | 70/332 |
| 2,836,052 | 5/1958 | Miller | 70/332 |
| 2,858,692 | 11/1958 | Deaton et al. | 70/332 |
| 3,024,640 | 3/1962 | Miller | 70/332 |
| 3,209,569 | 10/1965 | Bryson et al. | 70/442 X |

FOREIGN PATENT DOCUMENTS

| | | | |
|---|---|---|---|
| 6801188 | 4/1968 | Netherlands | 70/332 |

*Primary Examiner*—Thomas J. Holko

*Attorney, Agent, or Firm*—Poms, Smith, Lande & Rose

[57] ABSTRACT

A dial for a combination lock extends through a disc mounted on the housing for supporting the dial. A pair of interchangeable members, one being used at a time, are used in conjunction with the dial. The first interchangeable member is a spacer mounted on the disc between the dial and the disc for spacing the dial from the disc and covering a portion of the disc. The second interchangeable member is a cover mounted over the disc. The cover has a window through which the dial can be seen. The window includes a lens with thin plates therein for directing light from the dial in a certain path so that the dial can only be seen from one position. The cover has members for securing the lens in the window so that it is not easily removed therefrom.

5 Claims, 12 Drawing Figures

ALTERNATIVELY LISED
20
10
0
10
20
30
40
50
60
70
80
90
14
15
26
27
40
41
42
43
46
11
22
23
24
30
32
33
34
35
50

COMBINATION LOCKS

BACKGROUND OF THE INVENTION

Combination locks are useful in providing security for possessions. As better combination locks are constructed, surreptitious entry into the safe or other thing protected by the lock becomes more difficult. In many uses of combination locks, the sole importance attached to the lock is its ability to withstand typical attempts at surreptitious entry. However, many safes are entered by one who has seen the owner of a safe dial the combination. This is an especially important problem with respect to safes that are in plain view to persons not having the safe combination.

Such a person does not have to see the entire combination dialed at one time; he can learn one number each time he is able to look at the dial when the combination is being dialed. It may be easy to do this over a relatively short period of time without arousing suspicion of the person opening the safe.

In other applications, however, the combination dial is only visible to those having knowledge of the combination. For example, many one-person businesses have safes out of view of customers. No employees are around to glance at the owner while he is dialing the combination.

Viewing devices or materials have been proposed through which the owner of the safe can view the dial and the numbers thereon when dialing the combination but which prevent one not in a particular location to view the dial, and the present invention utilizes such material.

One object of the present invention is to disclose and provide a combination lock which has interchangeable members to provide for either unrestrictive viewing of the dial or to provide for restricted viewing of the dial depending on the safe owner's desires. A further object of the present invention is to disclose and provide a device which can be easily fit over the dial to allow only limited viewing of the dial.

The material that restricts viewing of the dial must be securely held in place. In the present invention, it is held in a window in a housing in front of the dial. If the view-restricting material is easily removed from the window, those authorized to open the safe may not notice the lack of the material, and the thief may learn of the combination before the material loss is discovered. Therefore, another object of the present invention is to disclose and provide a secure support for the vision-restricting material.

The meeting of these objects will be shown in the specification herein, and other objects, which will become evident in the specification, will also be met.

BRIEF DESCRIPTION OF THE DRAWINGS

There are three sheets of drawings.

FIG. 2 is a perspective view of the combination lock of the present invention.

FIG. 3 is a sectional view taken through plane III—III in FIG. 2.

FIG. 4 is another sectional view showing in detail the relationship between the disc which supports the dial on the housing and the spacer and dial.

FIG. 5 is a sectional view taken through plane V—V in FIG. 3, and shows an interchangeable member on the end of the dial.

FIG. 6 is a side view of the disc taken at plane VI—VI of FIG. 3.

FIG. 7 is a perspective view of the combination lock of the present invention with the cover thereon.

FIG. 8 is a sectional view taken through plane VIII—VIII of FIG. 7 showing the cover, dial and disc of the present invention.

FIG. 9 is a more detailed view, also in cross section taken through plane IX—IX of FIG. 7, and showing, in part, the relationship between the lens, which restricts viewing to the dial, and the window, which receives the lens.

FIG. 10 is a detailed side view of part of the window in the cover, and it is taken at plane X—X of FIG. 9.

FIG. 11 is a sectional view of a portion of the window taken through plane XI—XI of FIG. 10.

DETAILED DESCRIPTION OF THE PREFERRED EMBODIMENT

Figures 1, 12:
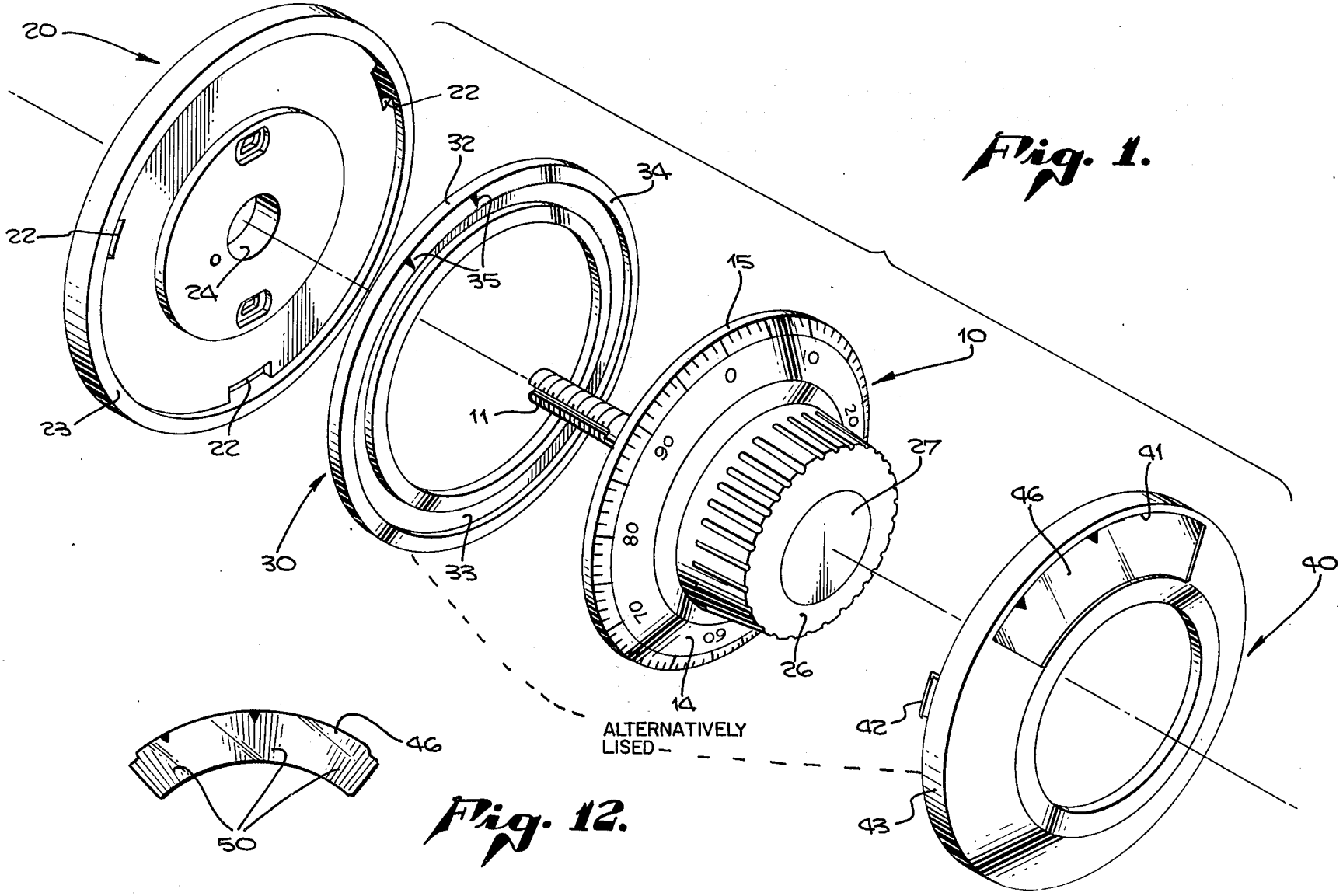
FIG. 1 is an exploded view of the combination lock of the present invention. It should be understood that at any one time, only one of the pair of interchangeable members will be used.
FIG. 12 (sheet 1) is a perspective view of the lens of the present invention.

The present invention is useful with combination locks. Such a combination lock includes a dial 10 having shaft 11 extending through opening 13 in housing 12. The dial is held in place by its connection with disc 20 on one side of housing 12 and by the combination lock mechanism (not shown) on the other side of housing 12.

Figure 3:
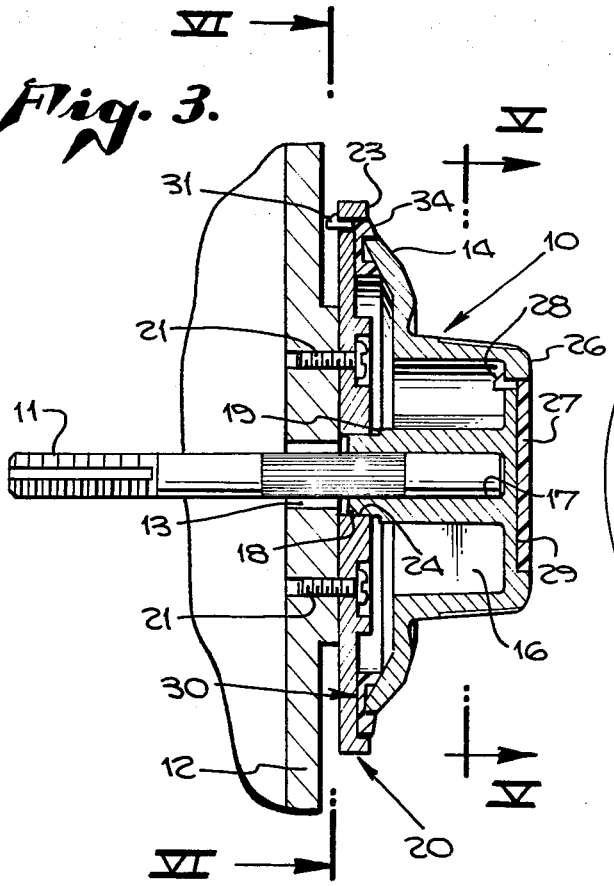
Figure 6:
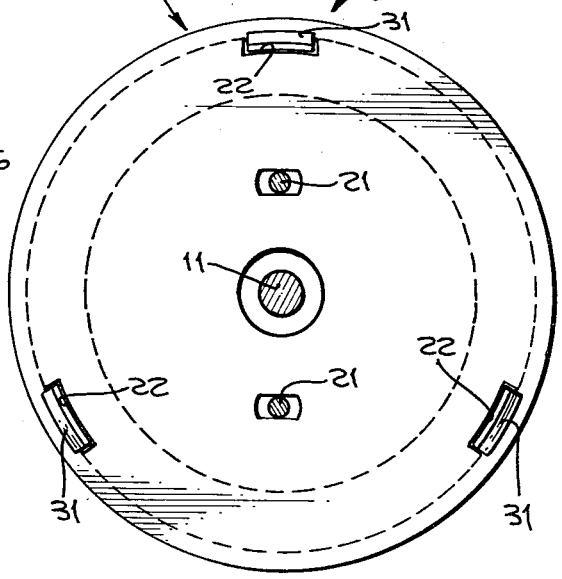
Figure 8:
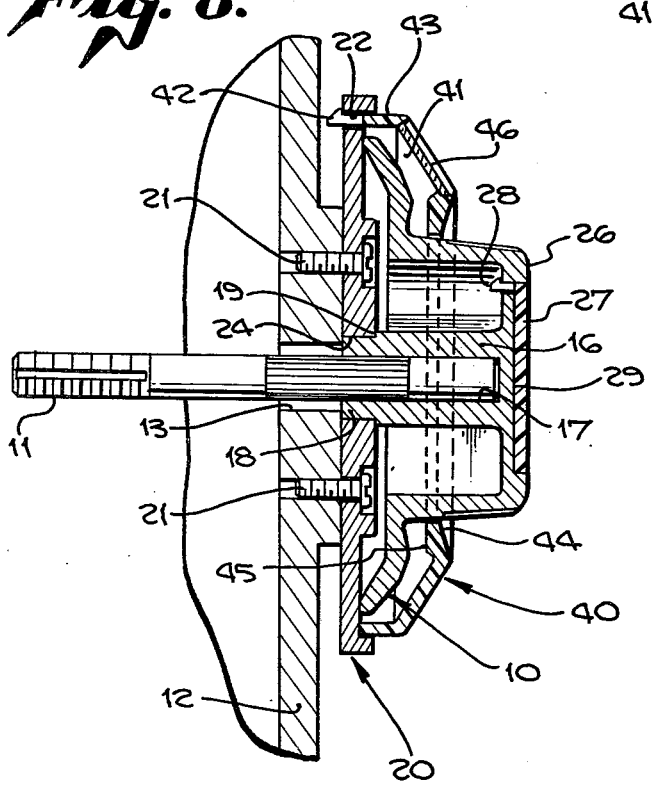

Disc 20 is fastened to housing 12 by means of screws 21 (FIGS. 3, 6, and 8). The disc is used with both interchangeable members. It is again noted that only one of the interchangeable members is used at a time.

The first interchangeable member comprises spacer means 30 (FIGS. 1–4). The spacer means is mounted on the disc between the dial and the disc for spacing the dial from the disc. The second interchangeable member comprises cover means mounted on the disc over at least a portion of the dial for covering the portion. The cover means has window means therethrough through which the dial can be seen. In the exemplary embodiment of FIGS. 7, 8 and 9, cover means 40 is mounted on disc 20 over dial 10. Dial 10 can be seen through window 41 through the cover.

The disc means comprises mounting means for releasably holding one of the interchangeable members, and both interchangeable members cover the mounting means so that the mounting means cannot be seen from the front of the disc. In the exemplary embodiment, the mounting means comprises slots 22 (FIGS. 1, 3, 4, 6, 9 and 10). The first interchangeable member, spacer means 30 includes an equal number of dogs 31. The dogs are adjacent the rim 32 of the spacer means so that the spacer means covers slots 22.

The cover 40 also includes dogs 42 similar to dogs 31 on spacer means 30 which fit into slots 22. Dogs 42 are also mounted at the rim 43 of the cover means so that slots 22 are not visible when the cover is in place.

The spacer means includes a groove in the front face thereof, and the dial has a rim for seating in the groove.

Figure 2:
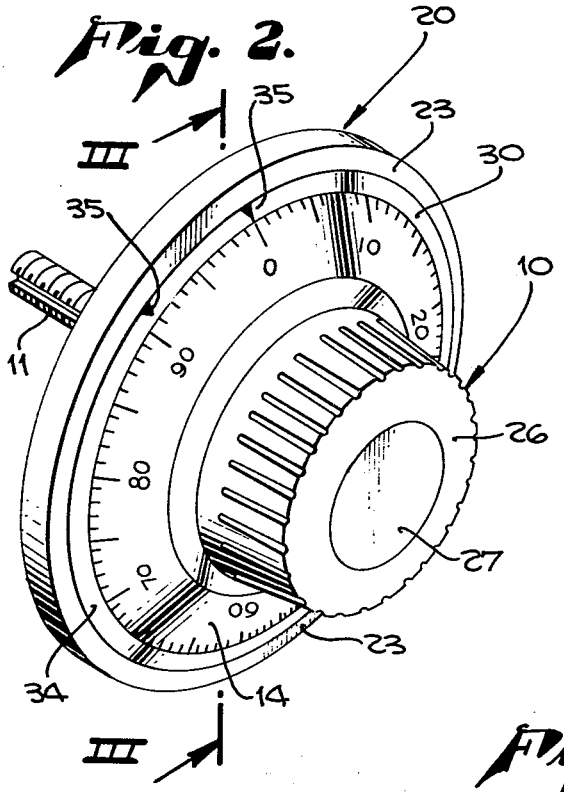
FIGS. 2 through 6 are on the second sheet of drawings and are directed, primarily, to the combination lock used without the cover restricting the view of the dial.
Figure 4:
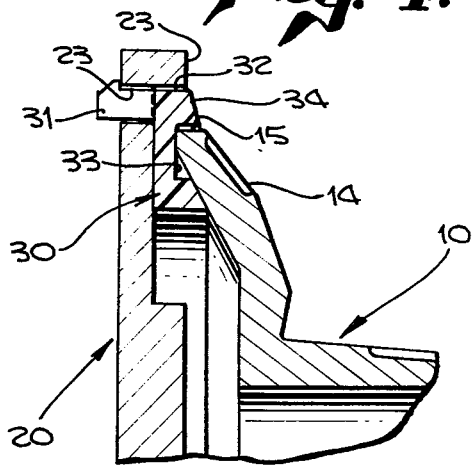
Figure 5:
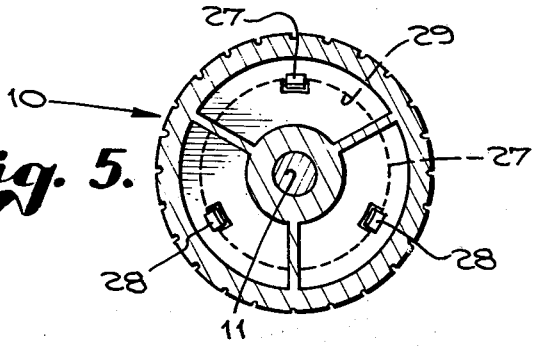

In the exemplary embodiment, the groove 33 (FIG. 4) on spacer 30 is near rim 32 of the spacer. Dial 10 has a sloping face 14 which slopes toward rim 15. The dial adjacent rim 15 seats in groove 33. This presents a neat and compact appearance for the dial. As shown in FIGS. 2–4, the face of the dial is sloping adjacent the rim, and the spacer 30 also has a sloping face 34 adjacent rim 32. Both sloping faces blend toward front face 23 of disc 20.

Indicia are provided on the spacer means adjacent the dial for indicating the position of the dial. In the exemplary embodiment, dial 10 has numbers spaced around sloping face 14. Indicia 35 are placed on sloping face 34 of the spacer so that the position of the dial can be determined.

Figure 7:
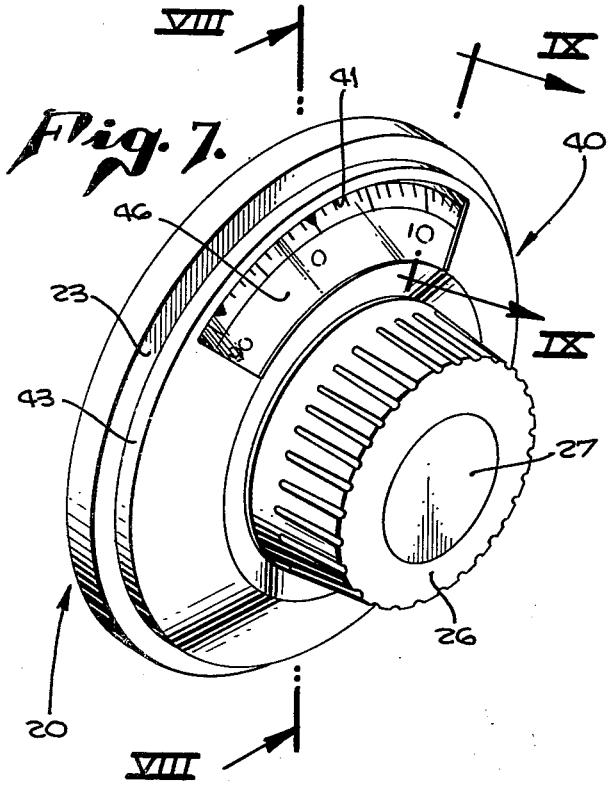
FIGS. 7 through 11 are related to the cover restricting vision to the dial.

The cover means has a front face facing away from the dial and a rear face facing the dial. In the exemplary embodiment, the front face is denominated element 44 and the rear face is element 45. The window means 41 is an arcuate opening as best shown in FIGS. 1 and 7, and as shown in the exemplary embodiment, permits one to view the numbers on the dial.

A lens 46 is mounted in the window against shoulders 47 and 48 (FIGS. 9 and 10) along the top and bottom of the arcuate opening. The shoulders are recessed from front face 44 of cover means 40.

Figure 9:
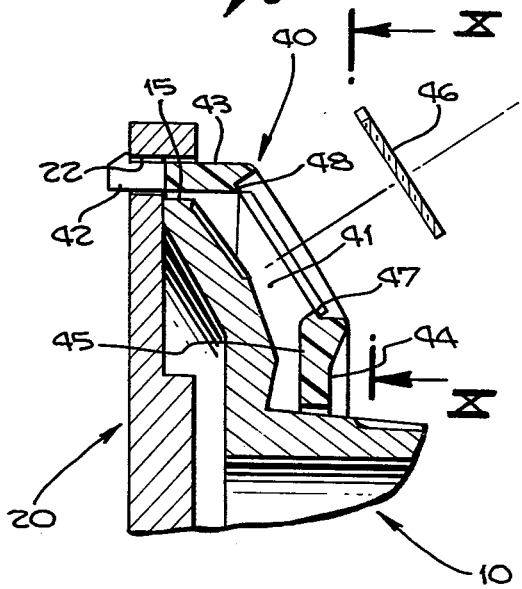
Figure 10:
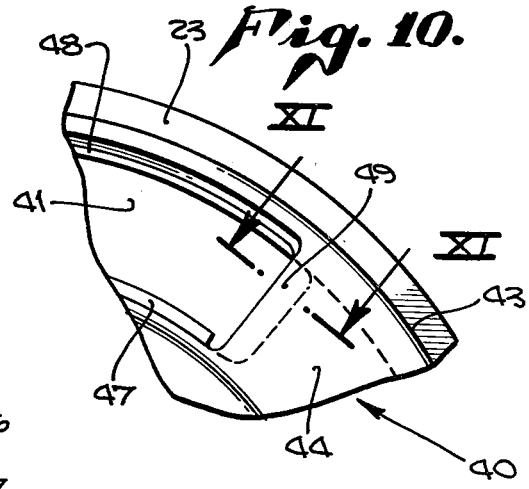
Figure 11:
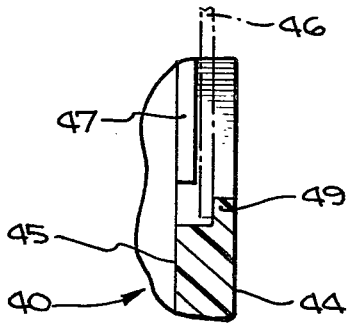

A portion of the lens extends beyond the sides of the rear of the arcuate opening when the lens is against the recess shoulders so that the lens is held against forward movement by the portion of the cover means at the sides of the opening and is held against rearward movement by the shoulders. In the exemplary embodiment, this is best shown in FIGS. 9, 10 and 11. FIG. 9 shows how the shoulders are formed at the top and bottom of the arcuate opening. The sides of the arcuate opening also form side shoulders 49 along the front face 44 of the cover. As shown in FIG. 11, side shoulder 49 prevents lens 46 from being moved forward, and shoulders 47 (and 48) prevent rearward movement of the lens.

As shown in FIG. 10, the recess is somewhat shorter than the height of window 41. Lens 46 has shorter side portions (FIG. 12) to fit into the short recesses. In that manner, the lens is more securely held in the window.

The lens is flexible so that it can be flexed during insertion into the opening whereby the portion of the lens adjacent the sides of the opening can be inserted there behind the rear face of the cover. This can easily be visualized with reference to FIG. 10. The sides of lens 46 are bent rearward and are inserted in the recess behind side shoulder 49. When the lens is released, it assumes its generally flat orientation against shoulders 47 and 48. The lens is securely held in place and is difficult to remove.

The lens includes a plurality of aligned shields in the lens for directing light from the dial only in the direction of the alignment so that the dial can only be seen from the location aligned with the alignment of the shielding means. The lens material of the preferred exemplary embodiment is 3 M light control film. Each lens 46 is formed by cutting the light control film in its arcuate shape. This maintains shielding means 50 parallel to each other. The shielding means are all perpendicular to the plane in the lens so that the dial is only visible directly in front of the lens. This is not shown in FIG. 7 so that the position of the elements can be shown. However, if the shielding means of the present embodiment were used in the lens of FIG. 7, the dial could not be seen from the position of the viewer. Only one standing directly in front of the lens could see the numbers.

If the lens is cut into a rectangular shape and then bent to the arcuate shape, the shields would not all be parallel and the portions of the shields near the top or wider diameter portion would be farther apart. This may make it possible for one to see the combination lock if he is looking through the top portion of the lens. Therefore, cutting the lens to the arcuate shape is preferred over bending it to the shape.

Dial 10 has a cylindrical center section 16 with a central bore 17. Shaft 11 is secured in bore 17. The cylindrical center section 16 has a narrow portion 18 which is journaled through bore 24 in disc 20. As shown in FIG. 8, when the cover means is used and there is no spacer interposed between the disc and the dial, shoulder 19 between narrow portion 18 and cylindrical section 16 rests on disc 20. In FIG. 3, with spacer 30 in place, there is a space between shoulder 19 and disc 20. However, the intersection between groove 33 and the rear outside face of dial 10 prevents movement of the dial to the left in FIG. 3. Movement to the right by the dial is prevented by the tumbler mechanism (not shown).

The front end 26 of dial 10 may support a nameplate 27 held by dogs 28 in recess 29. The dog arrangement is similar to that utilized by the cover 40 and the spacer 30 to hold them to disc 20.

It will be understood that various modifications and changes may be made in the configuration described above which may come within the spirit of this invention, and all such changes and modifications coming within the scope of the appended claims are embraced thereby.

I claim:

1. In a combination lock including a dial having a shaft extending into the housing of the combination lock for manipulating the tumblers of the combination lock and a disc mounted on the housing for supporting the dial, the improvement comprising:

a pair of interchangeable members, mounting means on the disc for alternatively mounting one of a pair of interchangeable members, the first interchangeable member comprising spacer means for spacing the dial from the disc, the spacer means having connector means thereon for covering and being held by the mounting means to hold the first interchangeable member to the disc and for covering the mounting means so it is not visible, the second interchangeable member comprising cover means for covering at least a portion of the dial, the cover means having connector means thereon for covering and being held by the mounting means to hold the second interchangeable member to the disc and for covering the mounting means so it is not visible, the cover means having a window through which the dial can be seen.

2. The improvement of claim 1 wherein the spacer means includes a groove on the front face thereof, the dial having a rim for seating in the groove.

3. The improvement of claim 2 further comprising indicia on the spacer means adjacent the dial for indicating the position of the dial.

4. The improvement of claim 15 wherein the cover means has a front face facing away from the dial and a rear face facing the dial, the window comprising an arcuate opening, top and bottom shoulders along the top and bottom of the opening, respectively, recessed from the front face of the cover means, the opening having top and bottom surfaces extending from the top and bottom shoulders to the front face, a lens mounted in the window against the top and bottom shoulders, the top and bottom shoulders being no closer together along their extent than the height of the lens, a portion of the lens extending beyond the sides of the rear of the arcuate opening when the lens is against the top and bottom shoulders and the top and bottom surfaces whereby the lens is held against forward movement by the portion of the cover means at the sides of the opening and is held against rearward movement by the top and bottom shoulders.

5. The improvement of claim 5 wherein the lens is flexible so that it can be flexed during insertion into the opening whereby the portion of the lens adjacent the sides of the opening can be inserted there behind the rear face of the cover means.

* * * * *

UNITED STATES PATENT AND TRADEMARK OFFICE

CERTIFICATE OF CORRECTION

PATENT NO. : 4,197,726

DATED : April 15, 1980

INVENTOR(S) : Tim M. Uyeda

It is certified that error appears in the above–identified patent and that said Letters Patent are hereby corrected as shown below:

Column 4 (within claim 4), line 64, change "15" to - - 1 - -.

Column 6 (within claim 5), line 4, change "5" to - - 4 - -.

Signed and Sealed this

*Second* Day of *December 1980*

[SEAL]

*Attest:*

SIDNEY A. DIAMOND

*Attesting Officer*

*Commissioner of Patents and Trademarks*